United States Patent [19]

Herman et al.

[11] 4,180,972

[45] Jan. 1, 1980

[54] COMBUSTOR SUPPORT STRUCTURE

[75] Inventors: Avrum S. Herman; Samuel B. Reider, both of Indianapolis, Ind.

[73] Assignee: General Motors Corporation, Detroit, Mich.

[21] Appl. No.: 913,744

[22] Filed: Jun. 8, 1978

[51] Int. Cl.[2] ..... F02C 7/20

[52] U.S. Cl. ..... 60/39.32; 60/39.69 R

[58] Field of Search ..... 60/39.31, 39.32, 39.74 R, 60/39.65, 39.66, 39.69; 431/352

[56] References Cited

U.S. PATENT DOCUMENTS

| | | | |
|---|---|---|---|
| 2,581,999 | 1/1952 | Blatz | 60/39.32 X |
| 3,064,424 | 11/1962 | Tomlinson . | |
| 3,064,425 | 11/1962 | Hayes . | |
| 3,075,352 | 1/1963 | Shutts . | |
| 3,349,558 | 10/1967 | Smith | 60/39.65 |
| 3,500,639 | 3/1970 | Stamm | 60/39.32 X |
| 3,557,553 | 1/1971 | Schmitz . | |
| 3,623,711 | 11/1971 | Thorstenson . | |
| 3,724,207 | 4/1973 | Johnson . | |

*Primary Examiner*—Carlton R. Croyle
*Assistant Examiner*—Edward Look
*Attorney, Agent, or Firm*—J. C. Evans

[57] ABSTRACT

A combustor assembly for a gas turbine engine includes a tubular, multi-layered porous metal wall with pores therethrough for distribution of compressor discharge air into a combustion chamber and wherein a rigid combustor support ring is connected to one end of the wall to receive an inlet diffuser member including an ovate inlet and a circular outlet connected to the support ring for axially directing primary air flow into the combustion chamber; and the diffuser member including a flow divider on one outer surface thereof including means for fixedly securing the inlet diffuser member with respect to a wall of a gas turbine engine and wherein coacting means are provided between the inlet diffuser member and the rigid combustor support ring of the combustor to radially connect it in place at one end thereof and wherein further coacting means are provided between the inner engine wall and a portion of the porous sleeve for axially indexing of the combustor assembly.

2 Claims, 3 Drawing Figures

COMBUSTOR SUPPORT STRUCTURE

The invention described herein was made in the course of work under a contract of subcontract thereunder with the Department of Defense.

This invention relates to gas turbine engine combustor apparatus and more particularly to such apparatus including wall components constructed of porous laminated metal to diffuse flow of combustion air from exteriorly of the combustion apparatus into an internal combustion chamber therein during gas turbine engine operation.

Canister type combustion apparatus and flame tube constructions typically include a plurality of axially directed sleeve segments connected together by offset air distribution systems to provide wall cooling of the liner segments of a combustor apparatus to prevent excessive flame erosion of the inside surface of combustor walls. Examples of such systems are set forth in U.S. Pat. Nos. 3,064,424, issued Nov. 20, 1962, to Tomlinson; 3,064,425 issued Nov. 20, 1962, to C. F. Hayes; and 3,075,352 issued Jan. 29, 1963, to L. W. Shutts.

Furthermore, in canister type combustor systems it is recognized that it is necessary to include a member to accurately fix and support the combustion liner with respect to an inner wall of a gas turbine engine so as to maintain the axis of a more or less cylindrically configured combustion can in generally parallel relationship with other combustors within an annular space defined by the inner wall of a gas turbine engine. An example of such a support system is set forth in U.S. Pat. No. 3,724,207, issued Apr. 3, 1973, to Douglas Johnson.

While the aforesaid canister type gas turbine engine combustor apparatus are suitable for their intended purpose, it is desirable to minimize flow of coolant air required to cool the inner wall of the combustion apparatus against flame erosion. Various proposals have been suggested to make the wall of the combustion apparatus of porous material to cool the internal wall combustion apparatus. One such arrangement is set forth in U.S. Pat. No. 3,557,553, issued Jan. 26, 1971, to Schmitz wherein porous metal fiber is compressed to provide a controlled amount of inlet coolant flow through pores in a mixing skirt and thence into a combustion chamber so as to obtain transpiration cooling of the interior wall of the combustion chamber. Another proposal for providing for a plurality of perforations to produce transpiration cooling effects on the interior wall of the combustion chamber is set forth in U.S. Pat. No. 3,623,711, issued Nov. 30, 1971, to Thorstenson. In both of these arrangements, the upstream end of the combustion liner is imperforate to define structural support for the liner apparatus within a gas turbine engine.

An object of the present invention is to provide an improved combustor liner configuration that incorporates a transpiration cooled porous metal liner from the inlet to the outlet of the combustor, with a dome of porous metal having a radially outwardly contoured ring segment with a radius to maximize air-fuel mixing volume and wherein a single support member on the dome also is a support for an associated swirler which is supported removably with respect to the dome and wherein pores and grooves in a laminated wall of the combustor are selected to minimize wall cooling air flow into the combustion chamber of the apparatus while maximizing combustion air flow, dilution air flow and pressure drop across the liner.

Yet another object of the present invention is to provide an improved combustion apparatus of the canister type including a tubular, porous metal liner with perforations therethrough from the inlet end to the outlet end of the combustion apparatus liner arranged to minimize flow of wall cooling air and wherein a single structural member serves as a support for the front end of the porous combustion liner and as a support for an associated primary inlet air swirler which can be replaced without cutting or welding of the structural components of the combustor assembly.

Still another object of the present invention is to provide an improved single member support for a combustion apparatus having a laminated porous metal sleeve perforated between the inlet and the outlet ends of the canister combustor in the form of an imperforate support ring connected to a porous metal dome of the combustor to support the apparatus circumferentially and radially at a housing for an associated swirler assembly with a fuel deflector ring thereon inboard of a fuel nozzle and wherein load is transferred through an inlet diffuser member from the support ring into a gas turbine engine inner wall or casing and wherein axial location of the combustor assembly is maintained through a pin connection between the gas turbine inner wall and an embossment on the outer wall of the perforated combustion liner component of the assembly.

Yet another object of the invention is to provide a canister type combustor assembly in an annular air duct for supplying combustion products to the turbine nozzle of a gas turbine engine with an axial compressor including a tubular, multi-layered porous metal wall with pores and grooves therethrough and having an inlet end and an outlet end and an internal combustion chamber therein for receiving maximized combustion and dilution air flow through said pores and grooves and wherein a dome of porous metal material has a radially outwardly contoured ring segment forming a mazimized air-fuel mixing volume and a rigid support ring has a radial flange connected to said ring segment; said support ring further including an axial extension outboard of said dome defining an axial air inlet.

A further object of the invention is to provide a combustor assembly as set forth in the preceding object with an inlet diffuser member for axially directing primary air flow into the inlet on said dome, the inlet diffuser member having a low profile inlet snout to direct compressor air flow toward said axial air inlet; the diffuser member further including an outlet end with a flared cone in axial alignment with said porous dome and including a circular lip on said cone spaced axially of said dome to accommodate axial movement between said dome and said diffuser member and wherein a flow divider is secured to one side of the inlet diffuser member including means thereon for fixedly securing the inlet diffuser member to the combustor support wall and means for axially slidably supporting said lip on the rigid support ring to permit free thermal expansion of the dome relative to the fixed inlet diffuser member for preventing excessive stress build up in the porous metal material of said dome.

Further objects and advantages of the present invention will be apparent from the following description, reference being had to the accompanying drawings wherein a preferred embodiment of the present invention is clearly shown.

Figure 1:
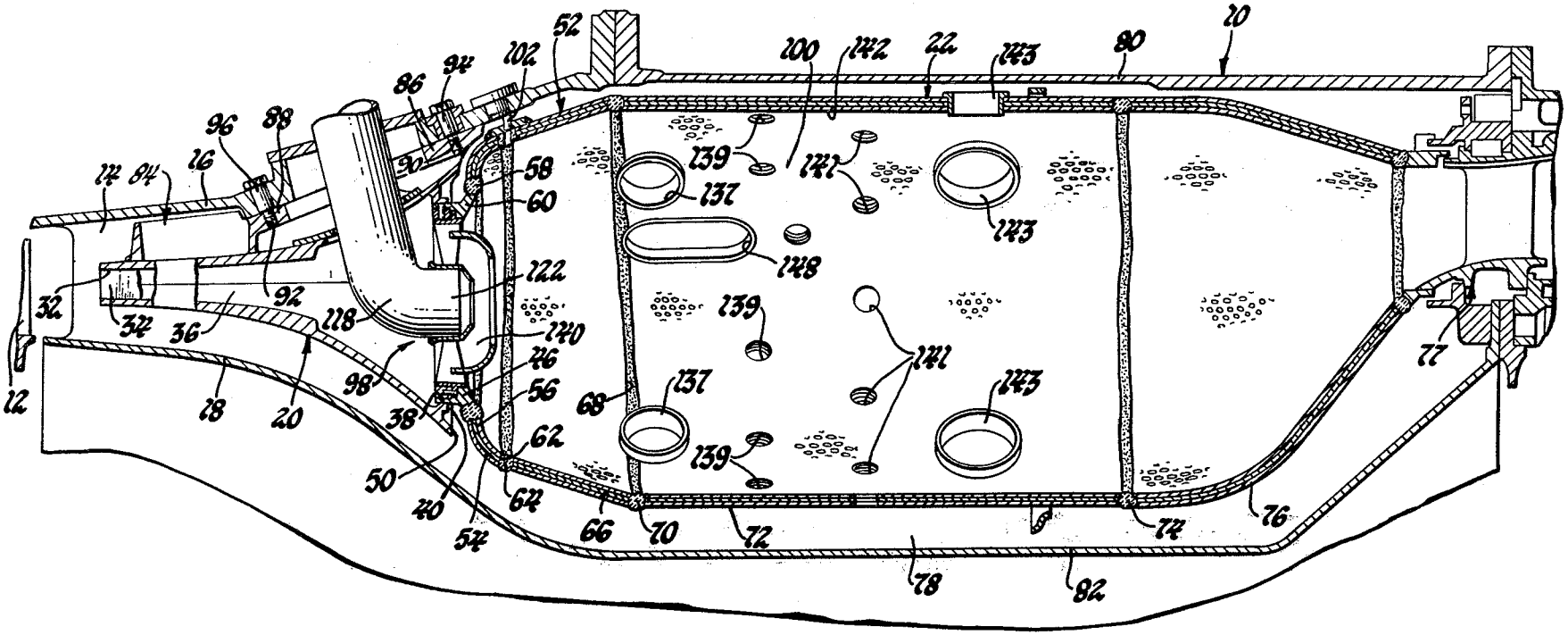
FIG. 1 is a longitudinal sectional view of a combustor apparatus in accordance with the present invention.

Referring now to the drawings, FIG. 1 has illustrated schematically therein, a portion of a gas turbine engine 10 having a compressor 12 of the axial flow type in communication with a discharge duct 14 defined by a first radially outer annular engine wall 16 and a second radially inwardly located annular engine wall 18.

An inlet diffuser member 20 is located downstream of the discharge duct 14 to distribute compressed air from the compressor 12 to a cannister type combustor assembly 22 constructed in accordance with the present invention.

More particularly, in the illustrated arrangement, the inlet diffuser member 20 includes a contoured lower plate 24 and a contoured upper plate 26 joined at their side edges by longitudinal seam welds 28, 30, respectively.

The plates 24, 26 together define a low profile inlet opening 32 located approximately at the mid-point of the duct 14. A flow divider plate 34 is located between the inlet ends of the plates 24, 26 to uniformly distribute compressed air flow into a radially divergent flow passage 36 formed between the lower and upper plates 24, 26, respectively, which are contoured to define a generally circular opening 38 at the outlet end 40 of the diffuser member 20 which is configured as a flared cone.

The lower plate 24 is joined to a downstream wall 41 with a support ring 42 thereon that is slidably supported on the outer annular surface 44 of a rigid support ring 46. A segment 48 of ring 42 on the upstream end of the upper plate 26 likewise is in axial sliding engagement with the ring 46 at the outer surface 44 which thereof to support a freely extending annular lip 50 at the outlet of the inlet diffuser member 20 for movement with respect to dome 52. The diffuser 20 is held in an axially and radially spaced relationship with the ring 46 to direct coolant flow to an airblast nozzle assembly 98 on the upstream end of a dome 52 of the combustor assembly 22. Moreover, the arrangement accommodates thermal expansion between dome 52 and inlet diffuser member 20.

The dome 52, more particularly, is made up of a first contoured ring 54 of porous laminated material that includes a radially inwardly located edge portion 56 thereon secured by an annular weld 58 to a radially outwardly directed flange 60 on the ring 46. Downstream edge 62 of ring 54 is connected by an annular weld 64 to a radially outwardly convergent contoured ring portion 66 of dome 52 also of porous laminated material. Rings 54, 66 have radii which produce a maximized air-fuel mixing volume within the dome 52 to receive air and fuel supply as will be discussed. The contoured ring 66 has its downstream edge 68 connected by an annular weld 70 to a porous laminated sleeve 72 which is connected by means of an annular weld 74 to a flow transition member 76 of the combustor assembly 22. Transition member 76 supplies a downstream turbine nozzle ring 77.

In accordance with certain principles of the present invention the inlet diffuser member 20 serves the dual purpose of defining a fixed support to locate the longitudinal axis of the combustor assembly 22 in parallel relationship to like canister combustor assemblies located at circumferentially spaced points within an annular exhaust duct 78 formed between an annular outer engine case 80 and an inner annular engine wall 82. To accomplish this purpose the inlet diffuser member 20 includes a side support or air flow divider 84 with a pair of spaced lands 86, 88 thereon with tapped holes 90, 92 formed therein to receive screws 94, 96 directed through the engine wall 16 to fixedly secure the inlet diffuser member 20 in place. Support ring 42 is thereby positioned axially by the ring 46.

Ring 46 also forms a housing for an air blast fuel atomizer assembly 98 that directs air and fuel into a combustion chamber 100 within the porous laminated sleeve 72. The assembly 98 includes provision for free axial sliding of a nozzle thereof with respect to ring 46.

Axial location of the combustor assembly 22 within wall 16 is established by means of a pin 102 held by a plug 104 secured by suitable clamp means (not shown) to the outside wall 16.

Figure 3:
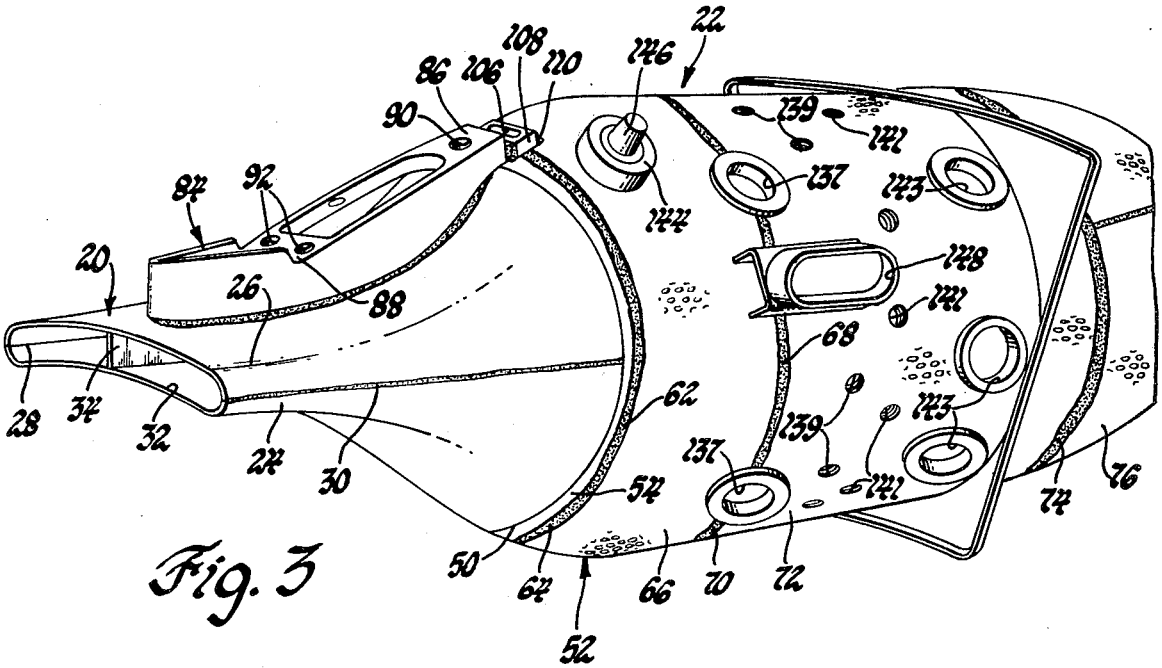
FIG. 3 is a view in perspective of the combustor apparatus in FIG. 1.

The pin 102 is located in interlocking relationship with a slot 106 of predetermined arcuate extent within an embossment 108 secured to the combustor assembly 22 by a weld 110 as best shown in FIGS. 1 and 3.

In the illustrated arrangement, the wall 16 includes an access opening 112 and a mounting pad 114 that is in alignment with an opening 116 in the upper plate 26 of the inlet diffuser member 20 to provide access for a fuel nozzle 118 portion of assembly 98. Nozzle 118 includes a generally radially outwardly directed stem portion 120 thereon and a nose portion 122 that is supported by an inner ring 124 of the assembly 98.

The assembly 98 further includes an outer annular shroud 126 thereon with a radial flange 128 supported by an undercut surface 130 on the inner periphery of ring 46.

Figure 2:
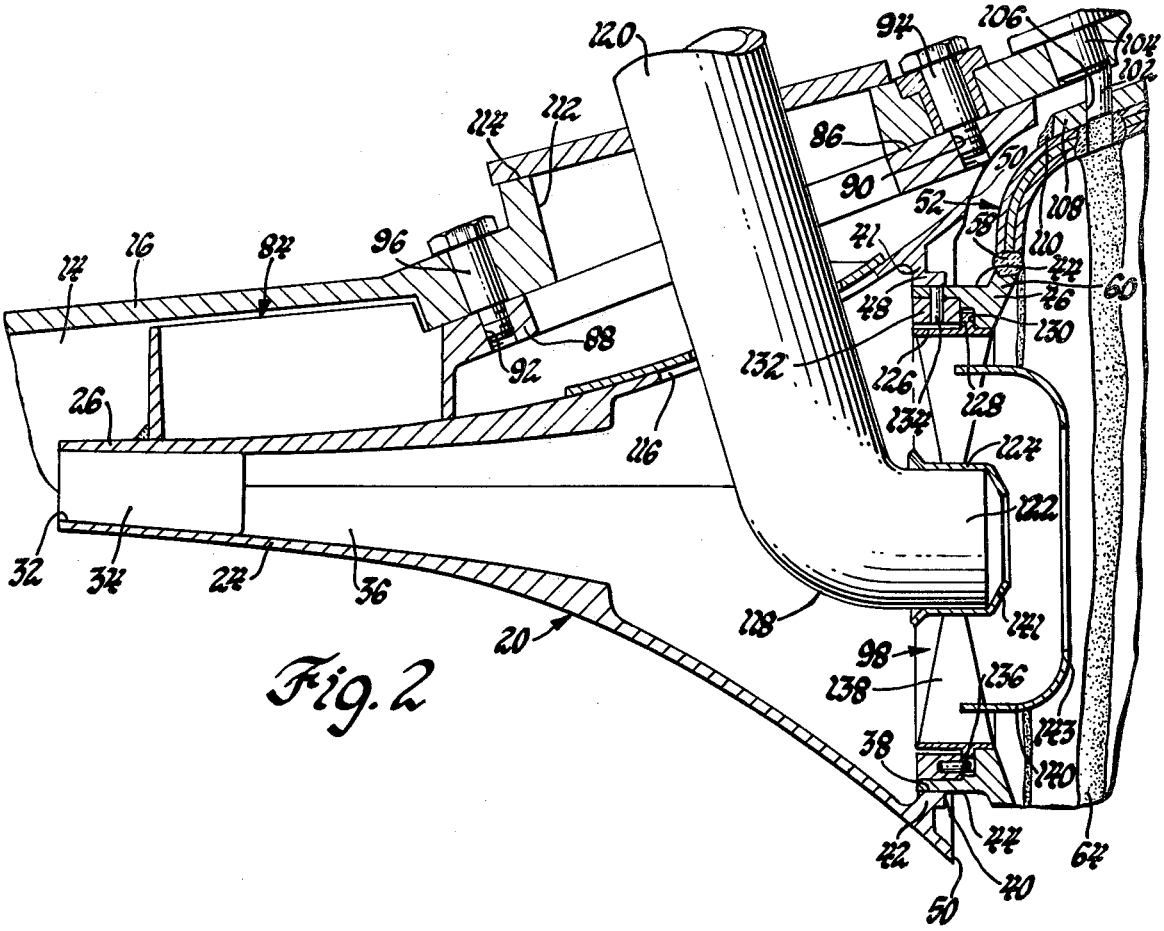
FIG. 2 is a fragmentary, enlarged sectional view of an inlet in FIG. 1.

The shroud ring 126 is fixedly secured with respect to the single structural support ring 46 by a locater ring 132 that is circumferentially fixed with respect to the support ring 46 by means of a radial pin 134. The shroud ring 126 is located in a circumferential direction by means of a pin 136 connected axially between the locater ring 132 and the radial flange 128 as best seen in FIG. 2.

The aforesaid support configuration defines a floating support for the assembly 98 to center the nozzle 118 and a plurality of inclined vanes 138 directed radially between the inner ring 124 and the shroud ring 126. The vanes 138 are angled to the longitudinal axis of the combustor 22 to produce a swirling action in air flow from the passage 36 into the combustion chamber 100. An intermediate annular guide ring 140 directs the swirled air radially inwardly for mixing with fuel from an outlet orifice in the nozzle 118 to thoroughly mix air-fuel to improve combustion within the chamber 100 during gas turbine engine operation. Lips 141 and 143 are formed inboard of rings 124, 140, respectively, to atomize fuel spray that mixes with air blast from the vanes 138.

The assembly 98 is thereby replaceable as a unit and includes a fuel supply to an air blast fuel injection system for the combustor assembly. A single support member in the form of ring 46 serves as a support for both the front end of a combustion liner and as a support for the swirler. Moreover, the floating swirler construction allows the vanes 138 to remain concentric with a fuel nozzle while the fuel nozzle and combustion liner are independently supported by the specially configured inlet diffuser member 20 and the associated air flow divider 84 thereon.

Another advantage of the present invention is that the liner of the combustor assembly 22 as defined by the liner rings 54, 66 and sleeve 72 produce a transpiration cooled wall construction that minimizes the requirement for wall cooling air while adequately cooling the inside surface of the combustor assembly exposed to the flame front within the combustion chamber 100.

The porous laminated material is made up of a plurality of porous plates having a flow pattern therein of the type set forth in U.S. Pat. No. 3,584,972 issued June 15, 1971, to Bratkovich et al. The pores and grooves have dimensions such that the liner has an effective area of 0.006 per square inch of liner wall area. Combustion air distribution into assembly 22 includes 11.5% total combustion air flow via assembly 98. A front row of primary holes 137 receives 14.5% of combustion air flow; a pair of rows of intermediate holes 139, 141 receive 8% and 5.6%, respectively, of the combustion air flow. Dilution holes 143 in sleeve 72 receive 35.8% of the combustion air flow. The remainder of the combustion air flow is through the liner wall. The aforesaid figures are representative of flow distributions in combustors using the invention. Cooling of the inner surface 142 of the sleeve 72 is in part due to transpiration cooling as produced by flow of compressed air from the duct 78 radially inwardly of the sleeve 76 through a plurality of pores and grooves therein fabricated in accordance with the structure of the aforesaid Bratkovich et al patent.

In the illustrated arrangement the liner includes a boss 144 at the ring 66 to serve as a mounting pad for a combustor ignitor assembly 146. Likewise, the combustor assembly includes a side located crossover port 148 thereon as shown in FIG. 3 to connect adjacent combustor assemblies (not shown) in the duct 78.

While the embodiments of the present invention, as herein disclosed, constitute a preferred form, it is to be understood that other forms might be adopted.

The embodiments of the invention in which an exclusive property or privilege is claimed are defined as follows:

1. A combustor support structure in an air duct for supplying combustion products to the turbine nozzle of a gas turbine engine having a combustor support wall comprising in combination: multi-layered porous metal combustor having an inlet end and an outlet end and an internal combustion chamber for receiving maximized combustion and dilution air flow through said porous metal wall, a dome of porous metal material secured to said combustor, said dome including a radially outwardly contoured ring segment forming a maximized air fuel mixing volume within said dome, a rigid support ring having a radial flange connected to said ring segment, said support ring further including an axial extension outboard of said dome, an air-blast nozzle on said extension defining an axial air inlet, an inlet diffuser member for axially directing primary air flow into the inlet of said dome, said inlet diffuser member having a low profile inlet snout to direct compressor air flow toward said axial air inlet, said diffuser member further including an outlet end with a flared cone in axial alignment with said porous dome and including a circular lip on said cone spaced axially of said dome to accommodate axial movement between said dome and said diffuser member, a support secured to one side of said inlet diffuser member including means thereon for fixedly securing the inlet diffuser member to the combustor support wall and means for axially slidably supporting said lip on said rigid support ring to permit free thermal expansion of said dome relative to said fixed inlet diffuser member for preventing excessive stress build-up in the porous metal material of said dome.

2. A support assembly for a canister type combustor in an annular air duct for supplying combustion products to the turbine nozzle of a gas turbine engine with an axial compressor including a combustor support wall internally thereof comprising in combination: a tubular, multi-layered porous metal wall having an inlet end and an outlet end and an internal combustion chamber therein for receiving combustion and dilution air flow through said porous wall, a dome of porous metal material secured to said inlet end having a radially outwardly contoured ring segment forming a maximized air fuel mixing volume within said dome, a rigid support ring having a radial flange connected to said ring segment, said support ring further including an axial extension outboard of said dome defining an axial air inlet, an inlet diffuser member for axially directing primary air flow into the inlet of said dome, said inlet diffuser member having a low profile inlet snout to direct compressor air flow toward said axial air inlet, said diffuser member further including an outlet end with a flared cone in axial alignment with said porous dome and including a circular lip on said cone spaced axially of said dome to accommodate axial movement between said dome and said diffuser member, a flow divider secured to one side of said inlet difuser member including means thereon for fixedly securing the inlet diffuser member to the combustor support wall and means for axially slidably supporting said lip on said rigid support ring to permit free thermal expansion of said dome relative to said fixed inlet diffuser member for preventing excessive stress build-up in the porous metal material of said dome.

* * * * *